US009877566B2

(12) United States Patent
Liard

(10) Patent No.: US 9,877,566 B2
(45) Date of Patent: Jan. 30, 2018

(54) CAP, AND COSMETIC CONTAINER, PARTICULARLY FOR COSMETIC STICK AND INCLUDING SAID CAP

(71) Applicant: ALBEA SERVICES, Gennevilliers (FR)

(72) Inventor: Jérôme Liard, Sainte Jamme sur Sarthe (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/104,322

(22) PCT Filed: Dec. 19, 2014

(86) PCT No.: PCT/EP2014/078884

§ 371 (c)(1),
(2) Date: Jun. 14, 2016

(87) PCT Pub. No.: WO2015/092029

PCT Pub. Date: Jun. 25, 2015

(65) Prior Publication Data

US 2016/0309880 A1 Oct. 27, 2016

(30) Foreign Application Priority Data

Dec. 20, 2013 (FR) ..... 13 63148

(51) Int. Cl.
*A45D 40/16* (2006.01)
*A45D 40/06* (2006.01)
(Continued)

(52) U.S. Cl.
CPC ..... *A45D 40/16* (2013.01); *A45D 40/02* (2013.01); *A45D 40/06* (2013.01); *A45D 2040/0062* (2013.01)

(58) Field of Classification Search
CPC ..... A45D 40/16; A45D 2040/0031; A45D 2040/0043; A45D 2040/005; A45D 2040/0062
See application file for complete search history.

(56) References Cited

U.S. PATENT DOCUMENTS 1,646,357 A * 10/1927 Noble ..... A45D 40/16 401/78
2,698,085 A * 12/1954 Schall ..... A45D 40/16 401/78
(Continued)

FOREIGN PATENT DOCUMENTS

EP 1803369 A2 7/2007
JP S6293919 U 6/1987
(Continued)

OTHER PUBLICATIONS

Feb. 4, 2015—Translation of the International Search Report of PCT/EP2014/078884.
Aug. 10, 2017—(EP) Office Action—App 14815386.9.

*Primary Examiner* — Jennifer C Chiang
*Assistant Examiner* — Bradley Oliver
(74) *Attorney, Agent, or Firm* — Banner & Witcoff, Ltd.

(57) ABSTRACT

The invention relates to a cap for cosmetic container, particularly for a cosmetic stick. Said cap (10, 20) is capable of receiving the cosmetic and is driven by a mechanism, referred to as an actuating mechanism (30), for actuating said container. The cap (10, 20) comprises two parts: a first part, referred to as a bottom cap (20), configured such as to engage with the actuating mechanism; and a second part, referred to as a top cap (10) capable of receiving the cosmetic. The bottom cap (20) and top cap (10) are separable from one another, the securing and/or separation of said two parts (10, 20) being achieved by resiliently deforming one portion of one of said two parts (10, 20) by means of the
(Continued)

other of said two parts (10, 20). The invention also relates to a cosmetic container, particularly for a cosmetic stick and including the above-mentioned cap.

16 Claims, 3 Drawing Sheets

(51) Int. Cl.
*A45D 40/02* (2006.01)
*A45D 40/00* (2006.01)

(56) References Cited

U.S. PATENT DOCUMENTS

| | | | | |
|---|---|---|---|---|
| 5,324,125 | A * | 6/1994 | Ackermann | A45D 40/16 401/78 |
| 2007/0147948 | A1* | 6/2007 | Murakoshi | A45D 40/16 401/75 |

FOREIGN PATENT DOCUMENTS

| | | | |
|---|---|---|---|
| JP | H043617 | U | 1/1992 |
| JP | 2006263271 | A | 10/2006 |

* cited by examiner

CAP, AND COSMETIC CONTAINER, PARTICULARLY FOR COSMETIC STICK AND INCLUDING SAID CAP

CROSS-REFERENCE TO RELATED APPLICATIONS

The present application is a U.S. National Phase filing of International Application No. PCT/EP2014/078884, filed on Dec. 19, 2014, designating the United States of America and claiming priority to French Application No. 1363148 filed Dec. 20, 2013, and the present application claims priority to and the benefit of both the above-identified applications, which are incorporated by reference herein in their entireties.

The field of the invention is packaging for cosmetic products. The invention more specifically relates to a cup and to a container for a cosmetic product, particularly for a stick of cosmetic product, in particular lipstick, comprising said cup.

It is known to provide such containers with a body, a mechanism for moving the cup, said cup supporting the stick of cosmetic product. Said movement mechanism is made up of said body and a guide mounted in this body. This mechanism makes it possible to drive the cup in rotation and/or in translation, in order to retract the stick of cosmetic product into the container, or to extend it therefrom to make it accessible to a user wanting to use it to apply make-up.

Once the user considers that the stick has been used up, they dispose of the container in its entirety.

To overcome this drawback, the prior art proposes containers comprising interchangeable or removable cups. However, the removable cups from the prior art are expensive—these are magnetic systems—or damage the stick of cosmetic product, for example when the replacement cup is inserted into the container.

One object of the present invention is to propose a cost-effective container that comprises a removable cup which limits undesired interference with the stick of cosmetic product.

Therefore, the invention relates to a cup for a cosmetic product container, in particular for a stick of cosmetic product, said cup being capable of receiving the product, and of being driven by a mechanism, referred to as a mechanism for actuating said container.

According to the invention, the cup comprises two parts: a first part, referred to as the lower cup, which is designed to interact with the actuating mechanism; and a second part, referred to as the upper cup, which is capable of receiving the product; it being possible to remove the lower cup and the upper cup from one another, said two parts being rigidly connected and/or disengaged by fitting said parts together using forces that are oriented tangentially to said upper cup.

The cup for a container of the invention has the advantage of proposing mechanical coupling between the lower and upper cups, which does not involve parts having high costs from an industrial point of view.

In addition, this coupling is carried out by elastic deformation in a direction of the forces involved, which means that the stick of cosmetic product cannot be damaged. Indeed, the upper cup that supports the stick of cosmetic product is not subjected to radial mechanical stress and the stick that it supports remains intact, even when the cup is being changed.

According to different embodiments of the invention, which may be taken together or separately:

said two parts are rigidly connected and/or disengaged by elastic deformation of the lower cup by the upper cup, said two parts are rigidly connected and/or disengaged by snapping a part projecting from the upper cup into a hollow part in the lower cup, the upper and lower cups are hollow, in particular having a circular cross section, the upper and lower cups are open at their ends, or are blind, the upper and lower cups each define an inner wall and an outer wall, the upper and lower cups extend in a main direction of longitudinal extension, referred to as the main axis, the upper cup comprises a male retaining means, said male retaining means projects from the outer wall of the upper cup, in a direction transverse to the main axis, in particular in a substantially orthogonal and/or radial direction, said male retaining means is capable of interacting with a female retaining means which is part of the lower cup, the female retaining means is a jaw capable of retaining the male retaining means, said jaw is capable of opening and/or closing in a direction orthogonal to the main axis and to said transverse direction, the male retaining means is a pin, in particular a substantially cylindrical pin, the pin and the jaw interact by means of a snap-in action, the male retaining means is integral with the upper cup, the upper cup is blind, the upper cup has an open first axial end and a closed second axial end opposite the first axial end, the upper cup has a through-hole in the vicinity of said second axial end in order to prevent a pistoning effect when it is joined to the product, in particular a stick of cosmetic product, the upper cup has a collar on its outer wall, in the vicinity of said first open end, said collar comprises a groove and/or a rib so as to allow a tool to engage therewith, the upper cup comprises, on its inner wall, ribs intended to ensure that the stick of cosmetic product is supported, said ribs are substantially parallel to one another, and to the main axis, the jaw is located at the bottom of a slot in the lower cup, the slot comprises a funnel-shaped opening at a first axial end of the lower cup, the slot extending along the main axis, towards the axial end of the lower cup opposite said first axial end, the lower cup has a bead of material in the vicinity of the bottom of the slot, said bead of material projects from the outer wall of the lower cup, in a direction substantially orthogonal to the main axis, in particular a radial direction, said bead of material is capable of interacting with the actuating mechanism, said bead is integral with the lower cup, the upper cup comprises a male guide means, which is separate from the means for retaining the upper cup, said male guide means projects from the outer wall of the upper cup, in a direction substantially orthogonal to the main axis, in particular a radial direction, said guide means is a rib, said guide means is integral with the upper cup, the guide means is intended to abut the inside of the slot in the lower cup, in particular when the lower cup and upper cup are rigidly interconnected and/or when the cup is moved, the cup according to the invention comprises two male retaining means, which are located opposite one another on either side of a plane including the main axis, the cup according to the invention comprises two female retaining means, which are located opposite one another on either side of a plane including the main axis, the cup according to the invention comprises two guide means located opposite one another on either side of a plane including the main axis, in particular between the retaining means and the open end of the upper cup, each guide means is located on a line which passes through one of the male retaining means and which is in parallel with the main axis, the upper cup comprises a shoulder such that a cross section of an upper part of the upper cup has an internal diameter that is greater than the internal diameter of a cross section of a lower part of said upper cup, the lower and upper cups are moulded, the lower and upper cups are made of plastics material.

The invention further relates to a cosmetic product container, in particular for a stick of cosmetic product, comprising a cup as described above.

According to the invention, said container further comprises a body and an actuating mechanism designed to drive the cup in a rotational and/or translational movement relative to the body.

The invention will be better understood, and its other aims, details, features and advantages will become more clearly apparent in the following detailed explanatory description of at least one embodiment of the invention given by way of purely illustrative and non-limiting example, with reference to the accompanying schematic drawings, in which.

As shown in FIG. 1 to 4, the invention relates to a cup for a cosmetic product container, in particular for a stick of cosmetic product. In this case, said container comprises a body 40, the cup 10, 20 which is provided so as to be capable of receiving the product, and a mechanism, referred to as an actuating mechanism 30, designed to drive the cup 10, 20 in a rotational and/or translational movement relative to the body 40.

The stick of cosmetic product is for example a stick of lipstick (not shown). Known sticks of lipstick have a circular cross section, although there are variants.

In this case, the cup 10, 20 has, as with known sticks of lipstick, a substantially circular cross section. However, this in no way excludes cups 10, 20 having complex cross sections (polygonal cross sections, cross sections of shapes that are made up of circular and straight parts, etc.) that are intended to receive sticks of lipstick that have a cross section similar to said cup 10, 20.

Figure 1:
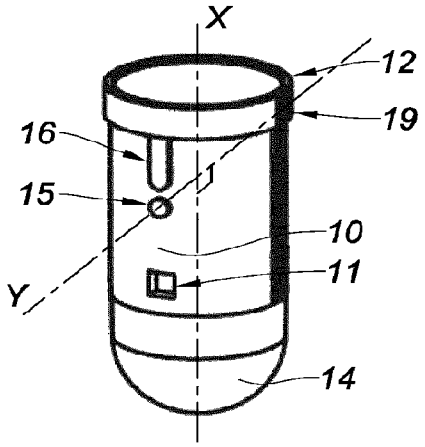
FIG. 1 is a perspective view of an embodiment of an upper cup according to the invention.
Figure 2:
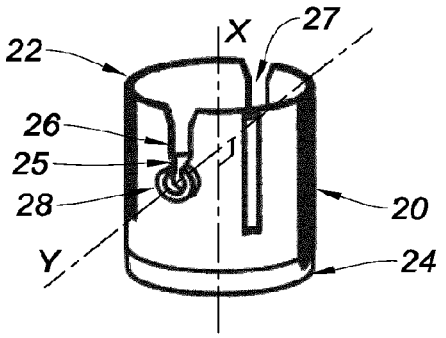
FIG. 2 is a perspective view of an embodiment of a lower cup according to the invention.
Figure 3:
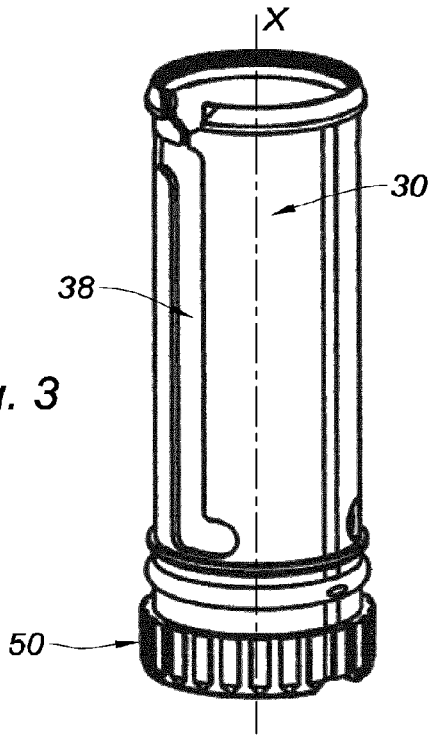
FIG. 3 is a perspective view of an embodiment of an actuating mechanism according to the invention.

FIG. 3 shows the actuating mechanism 30 which allows the cup 10, 20 shown in FIGS. 1 and 2 to be moved. The mechanism 30 shown in this figure is equipped with a guide groove 38. As mentioned above, the example of the mechanism 30 shown has a circular cross section, without this being limiting.

In addition, it is worth noting that the actuating mechanism 30, like the cup 10, 20, has a main direction of longitudinal extension, which will be referred to as the main axis in the following, and is represented by the axis X in the drawings.

In the example in FIG. 3, the groove 38 drives the cup in a translational movement along the axis X. This groove 38 is substantially rectilinear and parallel to the axis X. It is entirely conceivable for the mechanism 30 to comprise several parts, one of which has said groove and the other has a region 50 for gripping said container.

Figure 4:
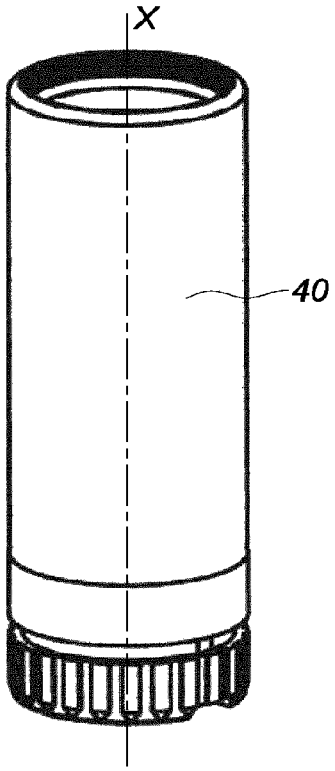
FIG. 4 is a perspective view of an example of joining the actuating mechanism from FIG. 3 to a container body according to the invention.

The body 40, which can be seen in FIG. 4, surrounds the mechanism 30. This body 40 is preferably opaque and may have decoration on its outer surface. The user of the container of the invention would hold the body 40 in one hand and drive the mechanism 30 using their other hand in order to, as already mentioned, retract the stick of cosmetic product into the container, or to extend it therefrom to make it accessible and to apply make-up therewith. More specifically, by actuating the mechanism 30, the user drives the retraction and/or extension of the cup 10, 20, which is capable of receiving the cosmetic product, in particular by means of interaction between the cup 10, 20 and a spiral-shaped channel (not shown) provided on an inner surface of the body 40. The invention is not limited to this type of actuating mechanism, and may equally operate using operating mechanisms that can be actuated using one hand, for example.

According to the invention, the cup 10, 20 comprises two parts: a first part, referred to as the lower cup 20, which is designed to interact with the actuating mechanism 30, and a second part, referred to as the upper cup 10, which is capable of receiving the product.

Figure 9:
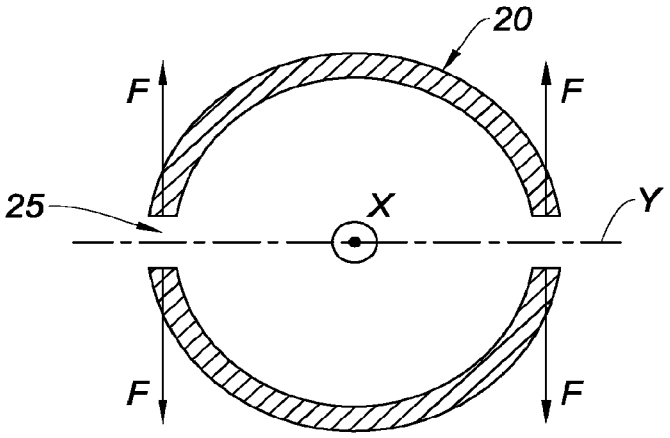
FIG. 9 is a diagram showing the forces that are exerted on the lower cup during the assembly/disassembly of the lower and upper cups.

The lower cup 20 is shown in FIG. 2. It is produced by moulding and has certain shapes, said shapes having different technical functions. A cross section of the lower cup 20 is shown in FIG. 9.

The lower cup 20 has two axial ends 22, 24: a first axial end, referred to as the top end 22, and an axial end opposite the top end 22 which will be referred to as the bottom end 24.

Figure 8:
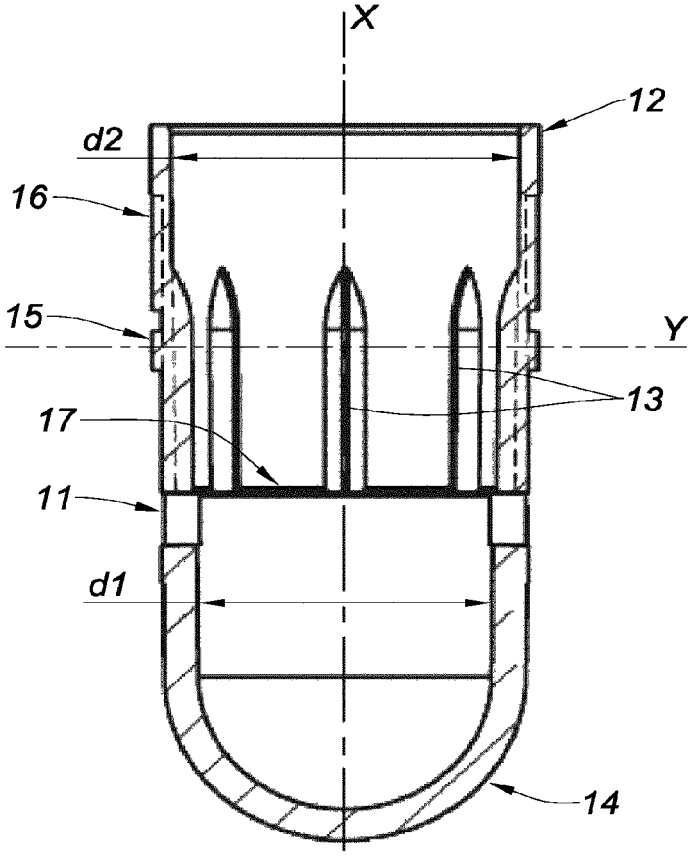
FIG. 8 is an axial sectional view of the upper cup from FIG. 1.

The upper cup 10 is shown in FIG. 1. It is also produced by moulding. An axial section of the upper cup 10 is shown in FIG. 8.

The upper cup 10 and lower cup 20 are hollow, in particular having a circular cross section, at least in the example shown in the drawings (non-limiting example). They each define an inner wall and an outer wall.

The lower cup 20 is open at both its ends 22, 24, while the upper cup 10 is blind, at least in the example shown in the drawings (non-limiting example).

As can be seen particularly clearly in FIG. 2, the lower cup 20 is split. It comprises in particular a slot 26 which has a funnel-shaped opening 27 at its top end 22. This slot 26 is a through-slot and it extends towards the bottom end 24, along the main axis X. In addition, this slot 26 ends in a jaw 25.

The interaction between the lower cup 20 and the actuating mechanism 30 is brought about by beads of material 28 that are positioned on the outer surface of the lower cup 20. These beads of material 28 are involved in driving the cup 10, 20 along the main axis X by engaging with the groove 38 in the mechanism 30 and with the channel in the body 40.

It is provided that the beads 28 are integral with the lower cup 20.

In addition, the beads of material 28 project from the outer wall of the lower cup, in a direction substantially orthogonal to the main axis X, which in this case is a radial direction, provided with reference sign Y in FIGS. 1, 2, 8 and 9.

In this case, the upper cup 10 comprises on its outer wall a male retaining means, referred to as a pin 15 in the following. This pin 15 is shown as being cylindrical, but it may be parallelepiped or any other shape (pyramidal, etc.). This pin 15 projects from the outer wall of the lower cup 20, preferably in the radial direction Y.

It is provided that the pin 15 is integral with the upper cup 10.

The pin 15 of the upper cup 10 is intended to interact with the jaw 25 of the lower cup 20, the jaw 25 being capable of opening and/or closing in a direction that is orthogonal both to the main axis X and to the radial direction Y.

It is indeed possible to remove the lower cup 20 and the upper cup 10 from one another, and said two parts 10, 20 are rigidly connected and/or disengaged by fitting said two parts 10, 20 together using forces that are oriented tangentially to said upper cup 10.

In particular, said two parts 10, 20 are rigidly connected and/or disengaged by elastic deformation of part of the lower cup 20 by the upper cup 10.

Therefore, this coupling is carried out by elastic deformation in a direction of the forces involved, which means that the stick of cosmetic product cannot be damaged. Indeed, the upper cup that supports the stick of cosmetic product is not subjected to mechanical stress and the stick that it supports remains intact, even when the cup is being changed. This in particular prevents radial forces from being imparted on the product.

Therefore, the container according to the invention comprises a removable cup which limits undesired interference with the stick of cosmetic product.

More particularly, the upper cup 10 and lower cup 20 interact by the pin 15 and the jaw 25 snapping together.

In other words, due to the direction given to the forces involved, the coupling/uncoupling of the upper cup 10 and lower cup 20 is carried out by deformation of the lower cup 20 only. This deformation, as shown in FIG. 9, means that the stick of cosmetic product contained in the upper cup 10 cannot be damaged. Indeed, the coupling/uncoupling of the two cup parts 10, 20 leads to deformation of the lower cup 20, without having an impact on the upper cup 10, and therefore without having an impact on the stick that it contains.

The cross section in FIG. 9 is shown in the vicinity of the jaw 25.

The interaction between the pins 15 and the two jaws 25 has another advantage, namely that of it being possible to angularly orient the upper cup 10, and therefore the stick of lipstick, relative to the lower cup 20, and therefore relative to the base 40.

Indeed, in the example shown here, the upper cup 10 comprises two pins 15, which interact with two jaws 25. These pins 15 form pairs with the jaws 25, and each pair of one pin 15 and one jaw 25 are positioned so as to face one another, on either side of a plane including the main axis X.

The angular orientation of the stick may therefore take place over a range of 180° (two pairs of one pin 15 and one jaw 25 positioned so as to face one another). The advantage is essentially commercial. For example, certain cosmetic product brands emboss their name on the stick of lipstick, and want their name to be visible to third parties when a user is applying this make-up.

The number of pairs of one pin 15 and one jaw 25 positioned so as to face one another may be higher. For example, three pairs of one pin 15 and one jaw 25 that are evenly distributed around the cup 10, 20 would allow an angular orientation that is close to 120°.

In addition, in order to ensure optimum coupling/uncoupling between the upper cup 10 and lower cup 20, ribs 16 are provided which, like the pins 15, project from the outer wall of the upper cup 10. These ribs 16 are separate from the pins 15; they are situated on a line that is parallel to the axis X passing through a pin 15.

In the example shown here, there are two of these ribs 16. Each of them is intended to abut the inside of one of the slots 26 in the lower cup 20, in particular when the lower cup 20 and upper cup 10 are rigidly interconnected and/or when the cup 10, 20 is moved.

In other words, these ribs 16 are guide means. They also prevent the upper cup 10 from tilting in the radial direction Y, in particular when the lower cup 20 and upper cup 10 are rigidly connected and the cup 10, 20 is retracted relative to the body 40 (see FIG. 7).

It is provided that the ribs 16 are integral with the upper cup 10.

In addition, the upper cup 10 and lower cup 20 are not joined together permanently. Therefore, the lower cup 20 is not designed to split, and especially not in the region of its jaws 25. By contrast, it is designed to withstand the two parts of the cup 10, 20 being joined together/disassembled a large number of times, in particular owing to elasticity in the region of its jaws 25.

Figure 5:
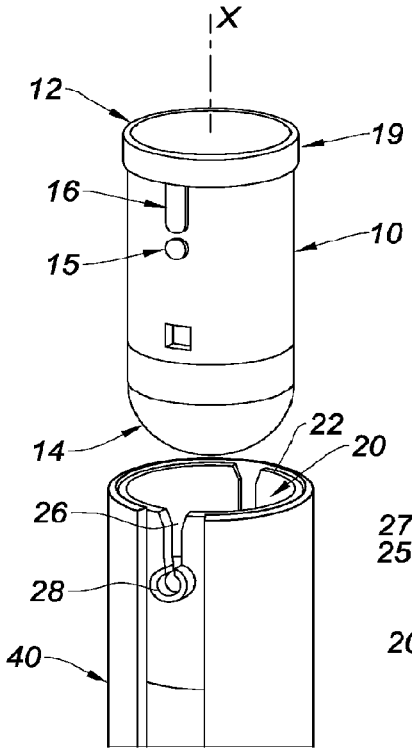
FIG. 5 is a cut-away perspective view of the assembly/disassembly of an upper cup of the type shown in FIG. 1 and a lower cup of the type shown in FIG. 2, the lower cup being shown as being mounted in an actuating mechanism of the type shown in FIG. 3.
Figure 6:
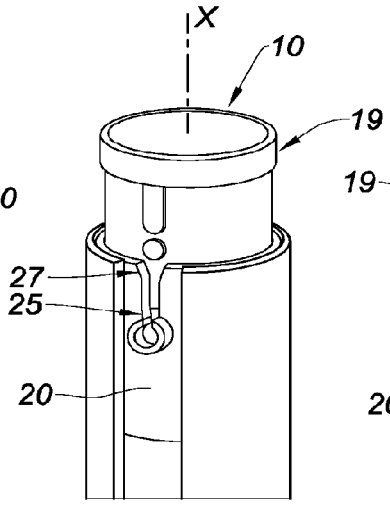
FIG. 6 shows the assembly/disassembly shown in FIG. 5, at a different stage.
Figure 7:
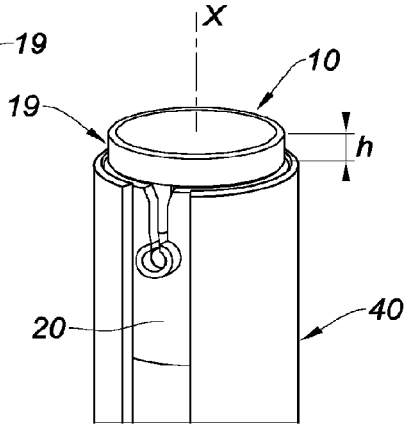
FIG. 7 shows the assembly/disassembly from FIGS. 5 and 6, the upper and lower cups being rigidly connected to one another.

In FIGS. 5 to 7, the lower cup 20 is shown as being mounted in the actuating mechanism 40. In particular, it can particularly be seen that the beads of material 28 are situated in the vicinity of the bottom of its slot 26, said beads being provided to interact with the grooves 38 in the actuating mechanism 30.

It is not provided for it to be possible to disassemble the lower cup 20 from the actuating mechanism 40 during the service life of the container of the invention.

In addition, as shown in FIG. 5, the upper cup 10 is blind; it has an open first axial end 12 and a closed second axial end 14, opposite said first axial end 12.

In FIG. 5, it can also be seen that the upper cup 10 has a collar 19 on its outer wall, in the vicinity of said first end 12. This collar 19 may comprise a groove and/or a rib (not shown).

This collar 19 is advantageous in that it allows the upper cup 10 to be handled, whether this is while it is being joined to the lower cup 20 or disassembled therefrom.

For example, on a production line, if the stick of cosmetic product has a manufacturing defect, it is sufficient to remove the upper cup 10 from the "body 40+mechanism 30+lower cup 20" assembly, referred to in the following as the "fixed assembly 20, 30, 40".

In other words, it is sufficient to scrap the upper cup 10 and the stick that has a manufacturing defect, while the fixed assembly 20, 30, 40 can be reused.

Another example involves the interchangeable nature of the upper cups 10 when the user wants to change the make-up shade, or simply when the stick of cosmetic product has been used up. The user therefore only has to disassemble the upper cup 10 from the fixed assembly 20, 30, 40 and then join a new upper cup 10 thereto that is equipped with the new stick of lipstick that has been selected.

As a reminder, FIGS. 5 to 7 show assembly (FIG. 5, 6 then 7)—or disassembly (FIG. 7, 6 then 5)—of an upper cup 10 and a lower cup 20 as described above.

Therefore, FIG. 5 shows an upper cup 10 and a fixed assembly 20, 30, 40. Here, the upper cup 10 is shown such that it is not rigidly connected to the fixed assembly 20, 30, 40.

FIG. 6 shows the engagement—or the disengagement—of the upper cup 10 with a view to rigidly connecting it to—or disengaging it from—the fixed assembly 20, 30, 40, in particular with a view to rigidly connecting it to—or disengaging it from—the lower cup 20. It is noted in this figure that the upper cup 10 passes through the lower cup 20, which is open at both its ends 22, 24. The funnel shape 27 at the inlet to the slot 26 makes it easier to join the upper cup 10 and lower cup 20 to one another, in particular to position the upper cup 10 in the lower cup 20.

FIG. 7 shows the upper cup 10 when it is rigidly connected to the fixed assembly 20, 30, 40. It is noted that, due to its collar 19, it is taller than a height h of the top end 22 of the lower cup 20. Said height h may for example be between 1 mm and 3 mm, and is preferably substantially equal to 2 mm.

FIG. 8 shows an example of the ribs 13 on the upper cup. These ribs 13 ensure that the stick of cosmetic product is supported in the upper cup 10. In the example shown, these ribs 13 are substantially parallel to one another, and to the axis X. This example of the ribs 13 is not limiting. Indeed, the invention is not limited to this example of the ribs 13, which may equally form an angle with the axis X, or may extend over a greater or lesser height along said axis X.

In addition, FIG. 8 shows, by way of reference sign 11, a through-hole in the vicinity of the second axial end 14. This through-hole 11 makes it possible to avoid any pistoning effect when the upper cup 10 is joined to the stick of lipstick. Indeed, this through-hole 11 is used to release the air that may be trapped while the stick is being joined to the upper cup 10.

It should be noted that the intermediate part—the upper cup 10—between the lower cup 20 and the stick of lipstick results in a reduction in the potential diameter of this stick. Indeed, compensation for the layer of additional material provided by the upper cup 10 has to be provided.

This is why the upper cup 10 of the invention has a shoulder 17 and a variation in internal diameter d1, d2 from this shoulder 17 (see FIG. 8). Therefore, the internal diameter d1, close to the second axial end 14, is provided to be less than the internal diameter d2, close to the first axial end 12.

For example, the value of the diameter d1 is between 11.5 mm and 12.5 mm, preferably substantially equal to 11.7 mm.

The value of d2 is for example between 11.7 mm and 12.7 mm, preferably substantially equal to 11.95 mm, or to 12.2 mm.

The diameter d2 is close to the external diameter of the cross section of the lower cup 20, in particular in the vicinity of its top end 22.

It should be noted that the stick of cosmetic product, or stick of lipstick, is also known as the "bullet". The container according to the invention makes it possible to use bullets of which the diameter is for example close to 12 mm. Therefore, the bullet retains a large diameter despite the two parts of the cup 10, 20.

The lower cup 20 and upper cup 10 are made of plastics material, although they may be made of metal material, or a combination of these materials.

It should further be noted that variants are of course possible. In particular, in an additional embodiment, the container has a parallelepiped body.

According to yet another additional embodiment (not shown), the male retaining means are provided on the outer wall of the lower cup in order to interact, for example by means of a snap-in action, with female retaining means that are supported by the upper cup, in particular by the outer wall of the upper cup, and allow the forces to be oriented tangentially.

The invention claimed is:

1. Cup for a cosmetic product container, in particular for a stick of cosmetic product, said cup configured to receive the product, and of being driven by a mechanism, referred to as a mechanism for actuating said container, said cup being characterised in that it comprises two parts:

- a first part, referred to as the lower cup, which is designed to interact with the actuating mechanism; and
- a second part, referred to as the upper cup, which is configured to receive the product; the upper cup having a circular cross-section; it being possible to remove the lower cup and the upper cup from one another, said two parts being rigidly connected and/or disengaged by fitting said parts together by elastic deformation in a direction tangential to the circular cross-section of the upper cup.

2. Cup according to claim 1, wherein said two parts are rigidly connected and/or disengaged by elastic deformation of the lower cup by the upper cup.

3. Cup according to claim 1, wherein the upper cup and the lower cup are hollow, are open at their ends or are blind, each define an inner wall and an outer wall, and extend in a main direction of longitudinal extension, referred to as the main axis.

4. Cup according to claim 3, wherein the upper cup comprises a male retaining means, which projects from the outer wall of the upper cup, in a direction transverse to the main axis, and which is configured to interact with a female retaining means which is part of the lower cup.

5. Cup according to claim 4, wherein the female retaining means is a jaw configured to retain the male retaining means, said jaw configured to open and/or close in a direction orthogonal to the main axis and to said transverse direction.

6. Cup according to claim 4, wherein the male retaining means is a pin.

7. Cup according to claim 6, wherein the jaw is located at the bottom of a slot in the lower cup.

8. Cup according to claim 7, wherein the slot comprises a funnel-shaped opening at a first axial end of the lower cup, the slot extending along the main axis, towards the axial end of the lower cup opposite said first axial end.

9. Cup according to claim 7, wherein the lower cup has a bead of material in the vicinity of the bottom of the slot, the bead of material projecting from the outer wall of the lower cup, in a direction substantially orthogonal to the main axis, the bead of material configured to interact with the actuating mechanism.

10. Cup according to claim 7, wherein the upper cup comprises a male guide means, which is separate from the means for retaining the upper cup and projects from the outer wall of the upper cup, in a direction substantially orthogonal to the main axis, the guide means being intended to abut the inside of the slot in the lower cup, in particular when the lower cup and upper cup are rigidly interconnected and/or when the cup is moved.

11. Cup according to claim 6, wherein the pin and the jaw interact by means of a snap-in action.

12. Cup according to claim 4, comprising two male retaining means and two female retaining means, which are located opposite one another on either side of a plane including the main axis.

13. Cup according to claim 3, wherein the lower cup comprises a male retaining means, which projects from the outer wall of the lower cup, in a direction transverse to the main axis, and which is capable of interacting configured to interact with a female retaining means which is part of the upper cup.

14. Cup according to claim 1, wherein the upper cup comprises a shoulder such that a cross section of an upper part of the upper cup has an internal diameter that is greater than the internal diameter of a cross section of a lower part of said upper cup.

15. Container for a cosmetic product, in particular for a stick of cosmetic product, comprising a cup according to claim 1.

16. Container according to claim 15, further comprising a body and an actuating mechanism designed to drive the cup in a rotational and/or translational movement relative to the body.

* * * * *